US009863202B2

(12) United States Patent
Rytlewski et al.

(10) Patent No.: US 9,863,202 B2
(45) Date of Patent: Jan. 9, 2018

(54) PROPELLANT ENERGY TO OPERATE SUBSEA EQUIPMENT

(71) Applicant: Schlumberger Technology Corporation, Sugar Land, TX (US)

(72) Inventors: Gary L. Rytlewski, League City, TX (US); Laure Mandrou, Bellaire, TX (US); David Allensworth, Pearland, TX (US); Quangen Du, Fresno, TX (US); Deepak Dcosta, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/102,235

(22) PCT Filed: Dec. 5, 2014

(86) PCT No.: PCT/US2014/068843

§ 371 (c)(1),
(2) Date: Jun. 6, 2016

(87) PCT Pub. No.: WO2015/085200

PCT Pub. Date: Jun. 11, 2015

(65) Prior Publication Data

US 2016/0312563 A1 Oct. 27, 2016

Related U.S. Application Data

(60) Provisional application No. 61/912,606, filed on Dec. 6, 2013.

(51) Int. Cl.
*E21B 33/035* (2006.01)
*E21B 23/04* (2006.01)
(Continued)

(52) U.S. Cl.
CPC ..... *E21B 33/0355* (2013.01); *E21B 23/04* (2013.01); *E21B 33/063* (2013.01);
(Continued)

(58) Field of Classification Search
CPC .. E21B 33/0355; E21B 33/063; E21B 33/064; E21B 34/04; E21B 34/045; F42D 1/04
See application file for complete search history.

(56) References Cited

U.S. PATENT DOCUMENTS 3,040,763 A 6/1962 Bouvier
4,163,477 A * 8/1979 Johnson ..... E21B 29/08 137/263

(Continued)

FOREIGN PATENT DOCUMENTS

WO 2004020776 A2 3/2004

OTHER PUBLICATIONS

International Search Report and Written Opinion issued in Patent Appl. No. PCT/US2014/068843 dated Mar. 23, 2015; 14 pages.

(Continued)

*Primary Examiner* — Matthew R Buck
(74) *Attorney, Agent, or Firm* — Tuesday Kaasch

(57) ABSTRACT

Systems and methods for using propellant as a force generator in component actuation are disclosed. One embodiment may take the form of a method including deploying at least one component to a subsea location, controlling operation of the at least one component using a control system, and igniting a propellant. The ignition of the propellant actuates the at least one component. Another embodiment may take the form of a subsea system including a control system, a propellant system in communication with the control system, and a component in communication with the propellant system. The propellant system is ignitable by the control system upon receipt of a ignite signal and upon (Continued)

losing communication with the control system after being placed in an armed state by the control system. The component is actuatable by the propellant system after ignition of the propellant system.

20 Claims, 6 Drawing Sheets

(51) Int. Cl.

| | |
|---|---|
| ***E21B 34/16*** | (2006.01) |
| ***E21B 41/00*** | (2006.01) |
| ***E21B 33/06*** | (2006.01) |
| ***E21B 33/064*** | (2006.01) |
| ***E21B 34/04*** | (2006.01) |
| ***F42D 1/04*** | (2006.01) |
| *E21B 34/00* | (2006.01) |

(52) U.S. Cl.
CPC ..... *E21B 33/064* (2013.01); *E21B 34/04* (2013.01); *E21B 34/16* (2013.01); *E21B 41/0007* (2013.01); *F42D 1/04* (2013.01); *E21B 2034/002* (2013.01); *E21B 2034/005* (2013.01)

(56) References Cited

U.S. PATENT DOCUMENTS 4,505,018 A * 3/1985 Regalbuto ..... B25C 1/12 227/9
4,619,111 A * 10/1986 Whiteman ..... E21B 33/06 60/632
5,316,087 A * 5/1994 Manke ..... E21B 23/065 166/381
8,186,425 B2 * 5/2012 Smart ..... E21B 43/263 102/320
8,316,872 B1 * 11/2012 Milanovich ..... E21B 33/061 137/68.13
8,567,427 B1 * 10/2013 Milanovich ..... E21B 33/061 137/68.13
8,794,308 B1 * 8/2014 Milanovich ..... E21B 33/062 166/335
8,839,871 B2 * 9/2014 Wright ..... E21B 23/04 166/165
8,997,875 B2 * 4/2015 Bennett ..... H01M 6/36 166/351
9,091,136 B2 7/2015 Allensworth et al.
2004/0089450 A1 5/2004 Slade et al.
2007/0240873 A1 10/2007 George et al.
2009/0211239 A1 * 8/2009 Askeland ..... F15B 1/24 60/327
2010/0155071 A1 6/2010 Gustafson
2011/0056679 A1 * 3/2011 Rytlewski ..... E21B 23/04 166/250.01
2011/0284237 A1 * 11/2011 Baugh ..... E21B 33/038 166/365
2013/0220161 A1 * 8/2013 Coppedge ..... C06D 5/00 102/531
2015/0198004 A1 * 7/2015 Rosa ..... E21B 33/063 166/244.1
2016/0108934 A1 * 4/2016 Wilie ..... E21B 33/0355 166/363

OTHER PUBLICATIONS

Search Report issued in European Patent Appl. No. 14868067.1 dated Aug. 18, 2017; 8 pages.

* cited by examiner

PROPELLANT ENERGY TO OPERATE SUBSEA EQUIPMENT

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of components may be installed in order to control, monitor, and enhance the efficiency of producing the various fluids from the reservoir. For example, in subsea wells, a variety of subsea components and control systems may be employed for controlling the subsea wells, for example, during emergency shutdowns. These systems may generally be powered hydraulically. That is, the force to actuate a particular component commonly is provided through hydraulics. For example, subsea annular accumulators have been used as failsafe power sources for shearing in subsea test trees (SSTT). Another system includes a hydraulic system converting low pressure input into high pressure output by utilizing hydrostatic pressure.

SUMMARY

Systems and methods for using propellant as a force generator in component actuation are disclosed. One embodiment may take the form of a method including deploying at least one component to a subsea location, controlling operation of the at least one component using a control system, and igniting a propellant. The ignition of the propellant actuates the at least one component. Another embodiment may take the form of a subsea system including a control system, a propellant system in communication with the control system, and a component in communication with the propellant system. The propellant system is ignitable by the control system upon receipt of a ignite signal and upon losing communication with the control system after being placed in an armed state by the control system. The component is actuatable by the propellant system after ignition of the propellant system.

Figure 1:
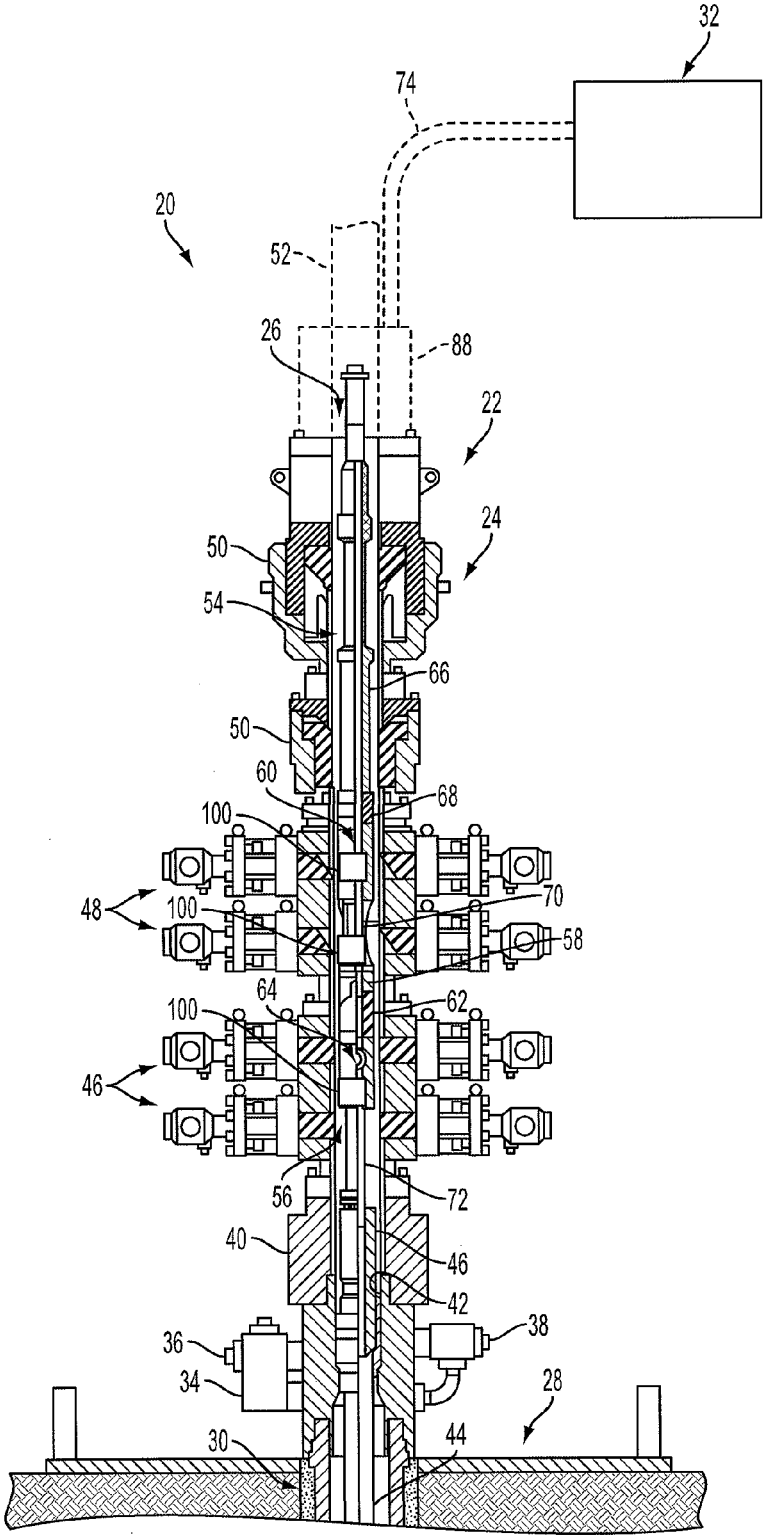
FIG. 1 illustrates a subsea installation and an associated control system with propellant powered components in accordance with an example embodiment.

Certain embodiments of the disclosure will hereafter be described with reference to the accompanying drawings, wherein like reference numerals denote like elements. It should be understood, however, that the accompanying drawings illustrate only the various implementations described herein and are not meant to limit the scope of various technologies described herein. The drawings show and describe various embodiments of the current disclosure.

DETAILED DESCRIPTION

In the following description, numerous details are set forth to provide an understanding of the present disclosure. However, it will be understood by those skilled in the art that the embodiments of the present disclosure may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the disclosure.

The present embodiments include systems and methods related to using propellant as a force to actuate components. In some embodiments, propellant may be used in lieu of hydraulics or electric actuation of a valve. For example, a ball valve, flapper valve or other valve may be opened or closed using the force generated by igniting a propellant. In another embodiment, a cutting device may be operated by ignition of a propellant. For example, a shear sub of a subsea test tree may be operated using force provided by ignition of a propellant. These and other example embodiments are discussed in further detail below.

Present embodiments use chemical energy to generate pressure on demand in a much smaller space than a nitrogen accumulator. The pressure is generated by igniting a pyrotechnic device that generates gas. As used herein, "propellant" may generally refer to a chemical that is produces energy and/or pressurized gas that is used to create movement of a fluid or another object, for example.

In some embodiments, the propellant ignition may be used in conjunction with electrical and/or hydraulic features. For example, the propellant may be ignited by a hydraulic or electrical signal. In some embodiments, the propellant may be used to push a piston that drives hydraulic fluid. As such, hydraulic elements may be implemented but the propellant ignition provides the force and determines at least in part the magnitude of the force applied to the actuation of components.

Turning to the drawings and referring initially to FIG. 1, a well system 20 is illustrated. Well system 20 may include a subsea installation 22 which includes a production control system 24 cooperating with a subsea test tree 26. The subsea installation 22 may be positioned at a subsea location 28 generally over a well 30 such as an oil and/or gas production well. Additionally, a control system 32 is employed to control operation of the production control system 24 and subsea test tree 26. The control system 32 may include an integrated system or independent systems for controlling the various components of the production control system and the subsea test tree.

Although the production control system 24 and subsea test tree 26 may include a variety of components depending on a specific application and environment in which the system is to be deployed, examples are discussed to facilitate an understanding of the present system and technique. In one example, production control system 24 includes a horizontal tree section 34 having, for example, a production line 36 and an annulus line 38. A blowout preventer 40, e.g. a blowout preventer stack, may be positioned in cooperation with the horizontal tree section 34 to protect against blowouts. These components also include an internal passageway 42 to accommodate passage of tubing string components 44 and related components, such as a tubing hanger/running tool.

The production control system 24 may also include a variety of additional components incorporated into or positioned above blowout preventer 40. One or more of the components may be actuatable using force generated by ignition of a propellant. For example, at least one pipe ram 46 may be mounted in subsea installation 22 at a suitable location and force generated by ignition of a propellant may drive the actuation of the valve. Two pipe rams 46 can be employed in some embodiments. The system 20 may also include at least one or more shear rams 48, such as the two shear rams illustrated, one or both of which may be actuated by propellant generated force. Additionally, one or more annular rams 50 may be employed in the system 20 which may also be actuated by propellant generated force. The various production control systems 24 accommodate a riser 52 designed to receive subsea test tree 26.

The subsea test tree 26 may include an upper portion 54 releasably coupled with a lower portion 56 via a connector 58, such as a latch connector. The upper portion 54 and the lower portion 56 may each contain at least one shut-off valve. The shut-off valve may be selectively actuated to block flow of production fluid through the subsea installation 22. The various components of subsea installation 22 are designed to allow an emergency shutdown. For example, subsea test tree 26 enables provision of a safety system installed within riser 52 during completion operations to facilitate safe, temporary closure of the subsea well 30. The control system 32 may provide electrical signals and/or hydraulic signals and/or power to the subsea test tree 26 to enable control over the shut-off valves. Control over the subsea test tree 26 may be independent of the safety functions of the production control system 24, such as actuation of blowout preventer 40.

The shut-off valves in subsea test tree 26 may range in number and design, and one or more of the shut-off valves may be actuated using force generated by a propellant. In one embodiment, the upper portion 54 may include a retainer valve 60. The lower portion 56 may include a pair of valves in the form of a flapper valve 62 and a ball valve 64. As illustrated, each of the shut-off valves may be paired with a propellant force generator 100.

As desired for a given application, other components may be incorporated into subsea test tree 26, and one or more of the other components may be actuated using force generated from a propellant. For example, the upper portion 54 may include a bleed off valve 68, and a shear sub 70 which may be actuated using propellant force generation. Additionally, the upper portion 54 may include a space out sub 66 and other components. The lower portion 56 may include additional components, such as a ported joint 72 extending down to tubing hanger 46, for example.

The shut-off valves may be controlled electrically, hydraulically, or by other suitable techniques, and an actuating force for each of the valves may be provided from ignition of a propellant. In some embodiments, the shut-off valves may be actuated by electrical and/or hydraulic techniques and the propellant actuation may be used as a back-up, supplementary, or emergency actuation, for example. As such, the propellant actuation may operate to actuate components alone or in combination with other actuation techniques.

In the embodiment illustrated, valves 60, 62, 64 are controlled hydraulically via hydraulic lines 74. For example, the position of the valves 60, 62, 64 may be controlled via a combination of opened or closed directional control valves 76 located in, for example, a subsea control module 78, shown in FIG. 2. The directional control valve 76 controls whether hydraulic pressure is present or vented on its assigned output port in the subsea test tree, for example. The hydraulic pressure may be used to control ignition of the propellant as discussed in further detail below. The force generated by the propellant ignition may be provided either directly to the component to be actuated or indirectly (e.g., via displacement of a piston which pushes hydraulic fluid in communication with the component. The directional control valves 76 within subsea control module 78 may be controlled via solenoid valves or other actuators which may be energized via electrical signals sent from the surface. Accordingly, the overall control system 32 for controlling subsea test tree 26 may have a variety of topside and subsea components which work in cooperation.

During a valve operation, an operations engineer may issue a command via a human machine interface 80 of a master control station 82, such as a computer-based master control station. In some applications, the master control station 82 includes or works in cooperation with one or more programmable logic controllers (PLC). Electric current may sent down through an umbilical 84 to the solenoid valves and subsea control module 78 to actuate directional control valves 76. The umbilical 84 also may include one or more hydraulic control lines extending down to the subsea control module from a hydraulic power unit 86. In the embodiment illustrated in FIGS. 1 and 2, the hydraulic lines 74 also are routed to an accumulator 88, such as a subsea accumulator module.

When a desired directional control valve 76 is opened, hydraulic pressure supplied by hydraulic power unit 86 is passed through its assigned output port to the subsea test tree 26. Conversely, when a directional control valve 76 is closed, hydraulic pressure present at its output port is vented. Hydraulic power is transferred from the subsea accumulator module 88 to a propellant force generator 100 associated with a particular valve 60, 62, 64 located in the subsea test tree 26. The designated valve transitions and fulfills the intended safety instrumented function for a given situation. For example, a valve may close.

An emergency shutdown sequence may be performed through a series of commands sent to one or more of the valves 60, 62 and 64. The emergency shutdown sequence may be designed to bring the overall system to a safe state upon a given command. Depending on the specific application, the emergency shutdown sequence also may control transition of additional valves, e.g. a topside production control valve, to a desired safety state. The use of a propellant actuation may provide more rapid response in an emergency situation as well as possibly higher force to accomplish a particular task associated with an emergency shutdown sequence (e.g., severing tubing).

If a complete loss of communication between the topside and subsea equipment occurs, i.e. loss or severing of the umbilical 84, the directional control valves 76 may be designed to return to a natural or default state via, for example, spring actuation. In some embodiments, this fail-safe actuation of the control valves 76 may be driven by the propellant force generator 100. In some embodiments, the propellant functionality may be redundant to the spring and in others it may be independent therefrom. This action brings the well to a fail-safe position with the topside riser and the well sealed and isolated. If the topside equipment is unable to bring the well into a safe state, then the operator can institute a block-and-bleed on the hydraulic power unit 86 to cause the subsea test tree to transition into its failsafe configuration. Additionally, visual and/or audible alerts may be used to alert an operator to a variety of fault or potential fault situations.

Figure 2:
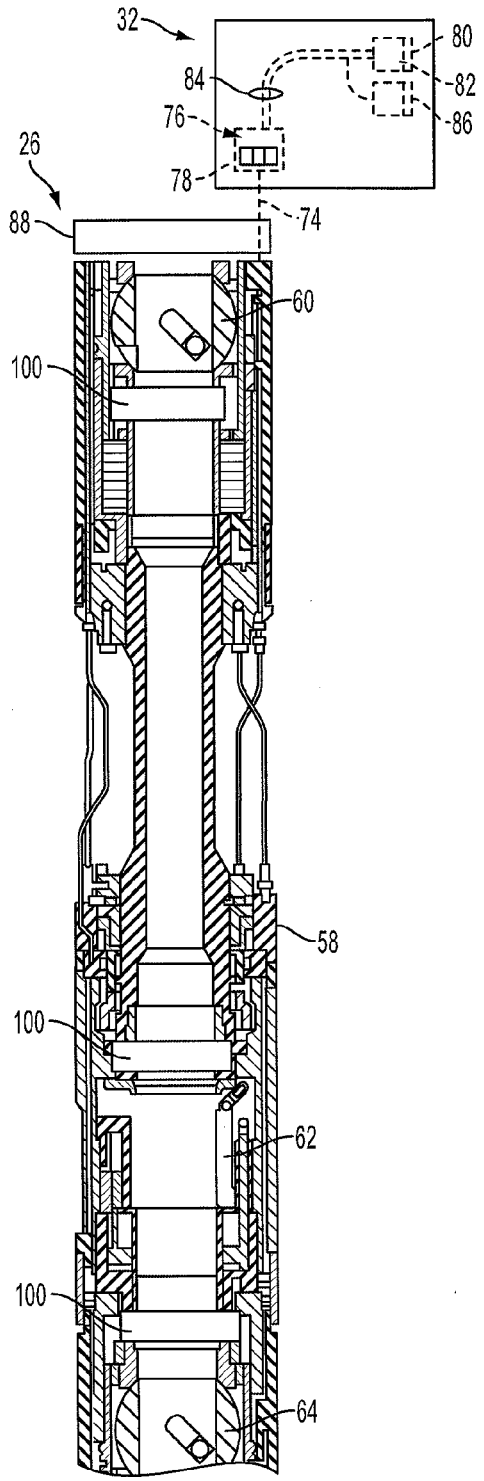
FIG. 2 illustrates of a portion of a subsea test tree that can be used at the subsea installation of FIG. 1 in accordance with an example embodiment.

In the specific example illustrated in FIG. 2, the subsea test tree 26 has four basic functions utilizing retainer valve 60, connector 58, flapper valve 62, and ball valve 64. The retainer valve 60 functions to contain riser fluids in riser 52 after upper portion 54 is disconnected from lower portion 56. The connector 58, e.g. latch mechanism, enables the riser 52 and upper portion 54 to be disconnected from the remaining subsea installation 22. The flapper valve 62 provides a second or supplemental barrier used to isolate and contain the subsea well. Similarly, the ball valve 64 is used to isolate and contain the subsea well as a first barrier against release of production fluid. As noted above, the valves and other components may be actuated using force from propellant force generator 100.

It should be appreciated that in some embodiments, the propellant force generator 100 may be integrated into and operate in conjunction with conventional components, such as the subsea test tree inside of a blowout preventer ("BOP") stack, and may provide more force than convention hydraulic force systems. One concern on rigs is the active heave motion compensator that maintains tension on a landing string. The compensator can lock up and a shear sub may be pulled into two parts by the tensile forces. This may separate valves below the shear sub from conventional hydraulic power used to close the valves and cutting devices. The valves may failsafe close but if there is coiled tubing or wire in the hole when the shear sub is parted or sheared, the valves not have sufficient force to shear and close if relying upon the spring force. An embodiment using propellant generated force may provide shearing force sufficient to achieve both the shearing and the closing of the valves. In some embodiments, the propellant actuation may be used as a redundant system to existing systems, as noted above. For example, in some embodiments, if a hydraulic system used to actuate components fails, is disconnected, or is unable to generate sufficient force to complete an operation, the propellant system may be ignited. In other systems, the propellant may be used instead of hydraulic or electrical actuation.

The use of a propellant system, such as propellant force generator 100, may provide space savings in certain applications. Specifically, for example, the distance from the shear ram to the tubing hanger is limited. In many BOP stacks, there is little extra length to accommodate nitrogen charged hydraulic accumulators with sufficient stored energy to shear coiled tubing. However, smaller accumulators may be implemented and used to ignite the propellant force generator 100, which would provide sufficient force for the sear operation.

Figure 3:
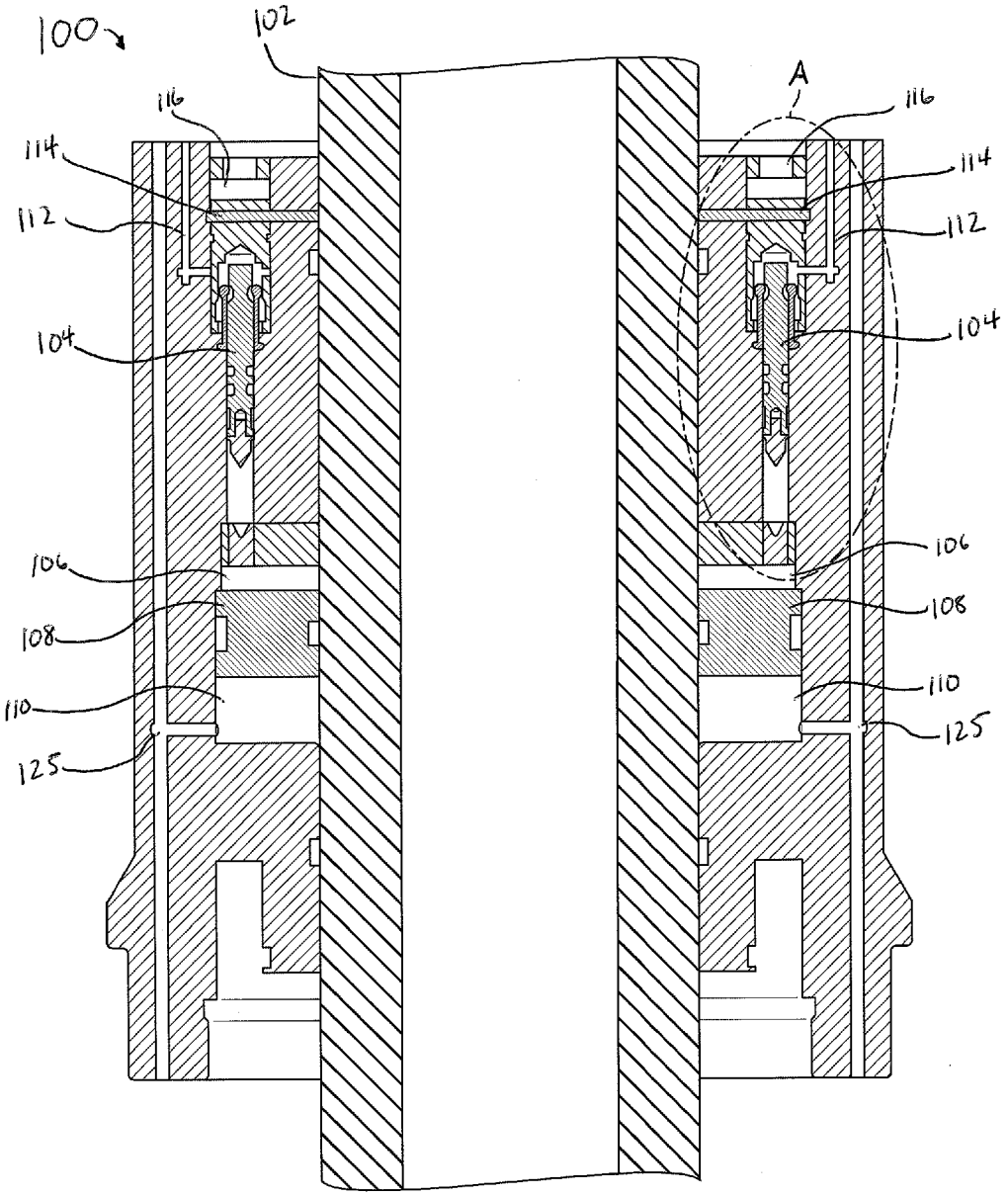
FIG. 3 illustrates a cross-sectional view of a propellant power system in accordance with an example embodiment.

FIG. 3 illustrates a cross-sectional view of the propellant force generator 100 in accordance with an example embodiment. As may be appreciated, the actual size of the packaging may depend upon the amount of force generation desired and amount of propellant to be used. Generally, however, the packaging may be in the range of a few inches to several inches or up to foot or greater, a measured longitudinally. The propellant force generator 100 may secure about a circumference of a tubular 102, in accordance with some embodiments. In other embodiments, the propellant force generator 100 may take different forms, shapes, and orientations to suit a particular design of a component to be actuated and/or a component to which the propellant force generator may be coupled.

The propellant force generator 100 may include at least one firing head 104, a volume 106 in which propellant may be placed, a piston 108, and a volume for hydraulic fluid 110 on an opposite side of the piston from the volume in which propellant may be placed. As illustrated, the propellant force generator 100 may include redundancy with respect to each of these features. Additionally, an upper end of the firing head 104 may be in communication with a control line 112 which may take the form of a hydraulic line, as discussed above. The control line 112 may be common between redundant firing heads 104. Additionally, a shear pin 114 may be positioned above the firing head 104 and a volume 116 above the shear pin may be open to the annulus.

Figure 4:
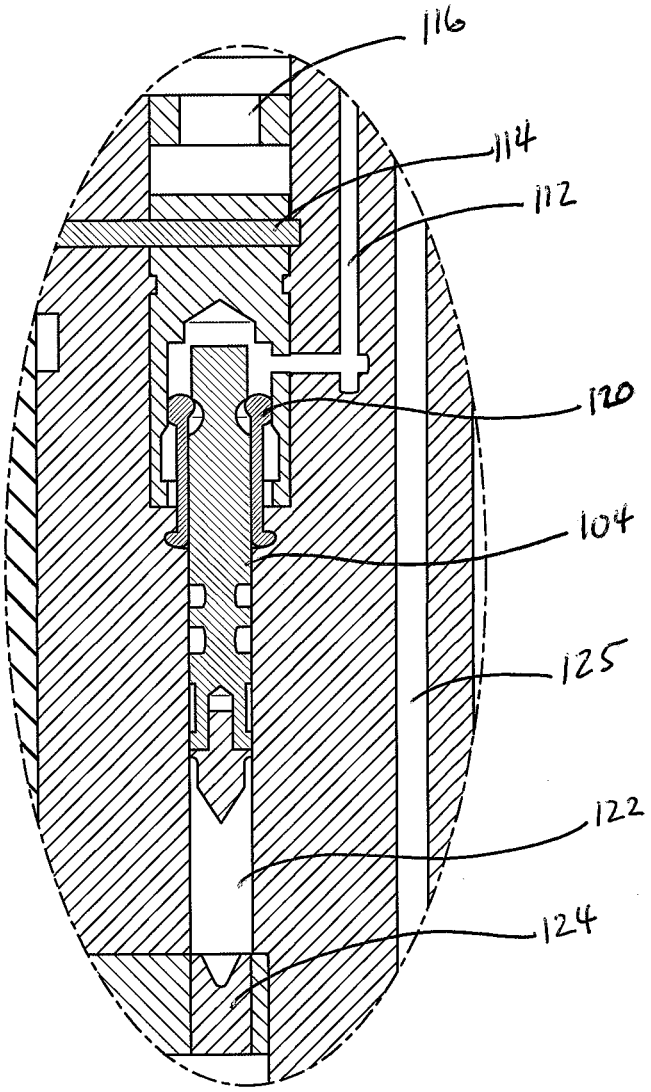
FIG. 4 is and enlarged view of the portion of the propellant power system of FIG. 3 circled with a dashed line.

FIG. 4 is an enlarged view of a portion of FIG. 3 encircled by the dashed line A. FIG. 4 shows the firing pin 104 held by prongs 120. In some embodiments, a volume 122 directly below the firing head 104 may be pressurized at approximately 1 atm, or another suitable pressure. Upon sufficient pressure supplied by the control line 112 to overcome the holding force of the prongs 120, the firing head is displaced downward. The firing head 104 passes through the volume 122 and impacts an igniter 124. The igniter 124 may take any suitable form and in some embodiments may be a suitable explosive, such HNS, for example. The igniter 124 is in contact with and, in turn, ignites or ignites the propellant to generate force. The force displaces the piston 108 and pushes hydraulic fluid via hydraulic line 125 to a component for actuation.

Other methods of igniting the propellant may include an electrical firing circuit powered by a downhole battery, charged capacitors, or from a surface power supply. Some of these and various other firing methods can be envisioned to arm and fire on loss of a signal or other situations, thereby providing a failsafe pressure source to shear and close subsea test tree valves and cutting devices.

As such, the firing mechanism may take various different forms. In one embodiment, propellant charges can be ignited or ignited through a mechanical circuit, such as the one illustrated in FIG. 5. In other embodiments, propellant charges may be ignited or ignited through electrical circuits FIG. 6. In still other embodiments, the propellant charges may be active or ignited by chemical reactions.

Figure 5:
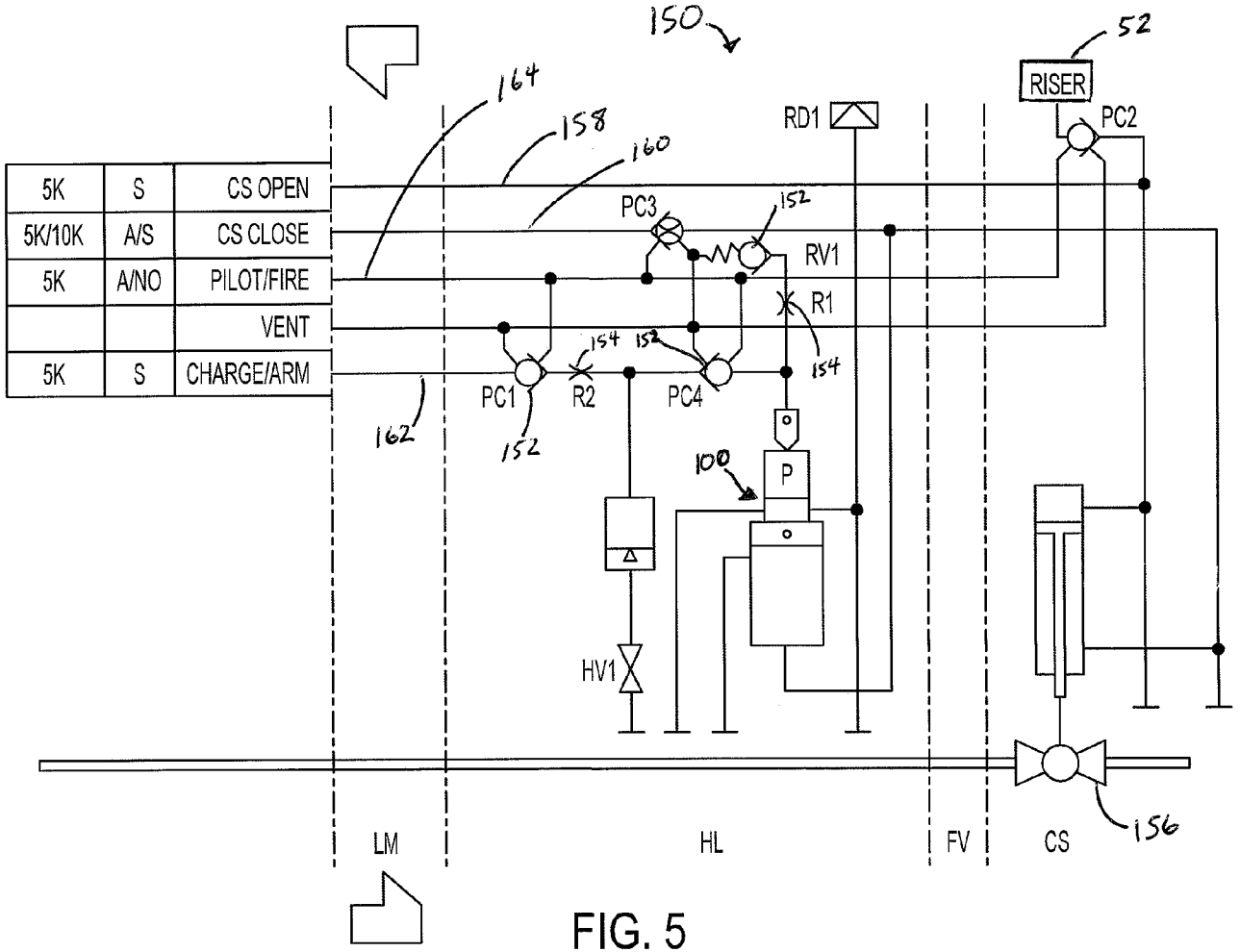
FIG. 5 is a schematic diagram of a hydraulically armed and fired propellant circuit in accordance with an example embodiment.

In FIG. 5, the hydraulic circuit 150 may As shown, the circuit may be in communication with the riser (e.g., 52) so that it may receive operation commands, for example, in the form of hydraulic signals. The hydraulic circuit 150 may include various components and features to effectuate a desired operation. Specifically, various check valves 152, flow restrictions 154 and so forth may be arranged to control operation of a component, such as a shut off valve 156. In an example embodiment, 5 k psi may be provided on an open line 158 to open the valve 156. Additionally, 5 k psi on a close line 160 may close the valve 156 when the pressure is removed from the open line 158. The propellant force generator 100 may be armed by a 5 k psi signal on an arm line 162 and ignited by a 5 k psi signal on a fire line 164. It should be appreciated that the example pressure levels noted above are merely examples and other pressures, indeed any suitable pressure level, may be used.

Figure 6:
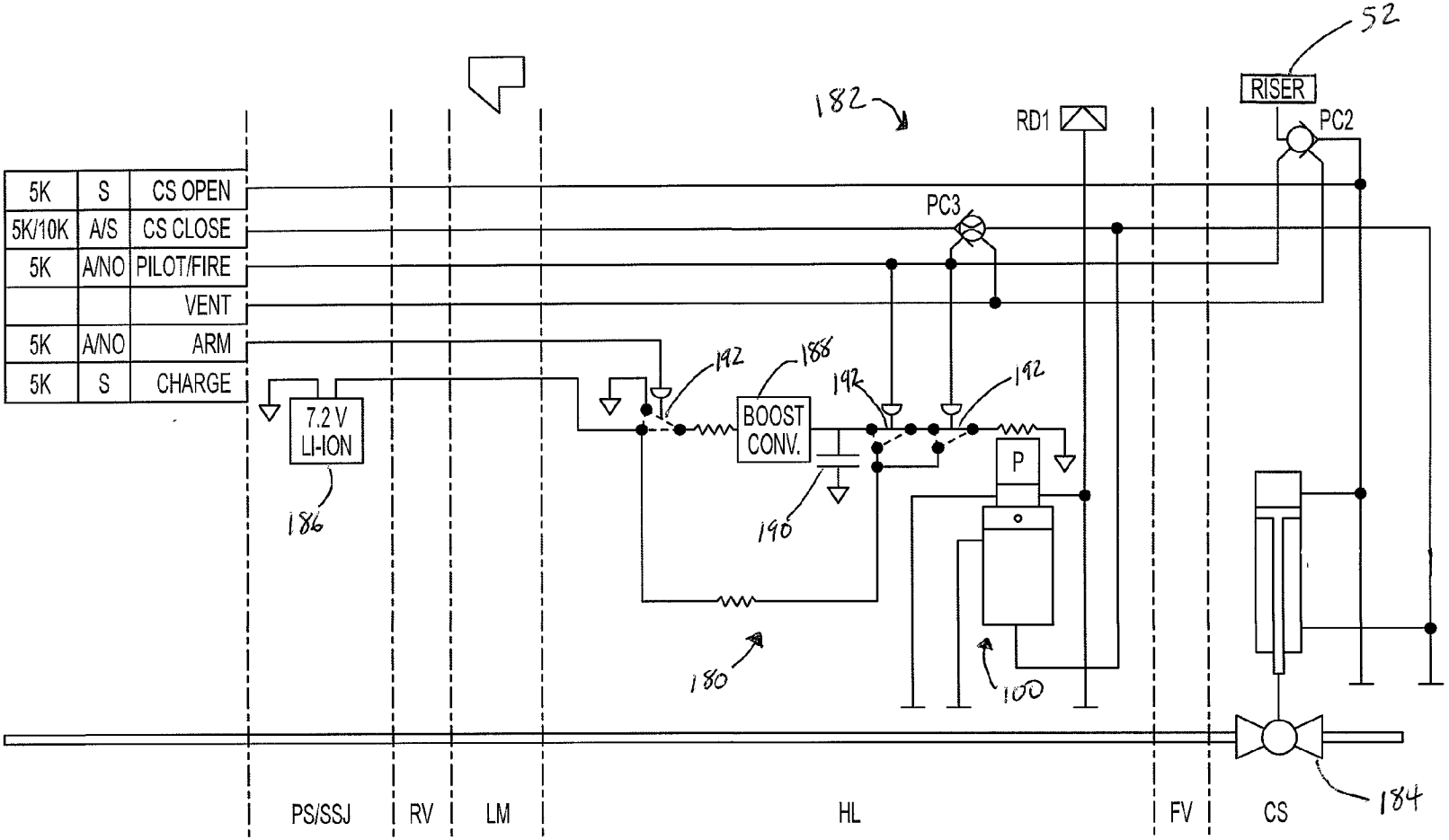
FIG. 6 is a schematic diagram of an electrically charged propellant circuit in accordance with an example embodiment.

In FIG. 6, an electrical circuit 180 may be used with a hydraulic circuit 182. The hydraulic circuit 182 may generally operate the valve 184. The electrical circuit 180 may generally be used in ignition of the propellant 100. The electrical circuit 180 may include various different component parts. For example, the electrical circuit 180 may include a battery 186, a boost converter 188, capacitors 190 and switches 192. The electrical circuit 180 and hydraulic circuit 182 may interoperate together to achieve a desired functionality for the propellant 100 in actuating the valve 184.

The example firing circuits may fire with the loss of one or more signals with high reliability and cannot fire unintentionally. For example, both of the circuits illustrated in FIGS. 5 and 6 include arming the firing circuit & disarming the firing circuit by commands from the surface. In the armed state, the propellant may be fired and will only fire on the loss of a signal or multiple signals. In the disarmed state, the energy to fire the propellant will be dissipated or compensated to an inert level and therefore cannot fire the propellant. Many different ways of achieving this arm and disarm feature may be understood. As such, FIGS. 5 and 6 are presented merely as example embodiments.

In each of the example circuits of FIGS. 5 and 6, the arm and disarmed states can be changed on command from surface. This surface command may be via electrical wire, hydraulic pressure, hydraulic pulse(s), mechanical motion from intervention tool, flow in tubing or riser or acoustic signals, among others.

As may be appreciated, embodiments may generally use propellant to replace the large volumes of compressed gas stored in hydraulic accumulators and offer several advantages over conventional gas charged subsea accumulators, including, but not limited to: smaller volume; propellant can be placed closer to the components to be actuated and deliver the energy to operate the valves, rams, connectors or other subsea devices much faster; and the use of the propellant can replace the gas charged accumulators thereby reducing weight, cost and safety issues related to charging large volumes with high pressure gas.

Another characteristic of a propellant force generator 100 is a surge in pressure occurs in the initial seconds and then cools to lower steady state pressure naturally. For some operations, the surge in pressure can be advantageous to close shear devices or to break friction. Static friction could come from high differential pressures or from being dormant for long periods of time. Numerous other applications subsea can be envisioned.

Common propellants that may be implemented in certain embodiments are energetic materials and include a fuel like gasoline, jet fuel, rocket fuel, and an oxidizer. Propellants may be burned or otherwise decomposed to produce the propellant gas. Other propellants may include liquids that can readily be vaporized. Propellants may be used to produce a gas that can be directed through a nozzle, thereby producing thrust. Propellant may be used to produce an exhaust which may be expelled under pressure through a nozzle. The pressure may be from a compressed gas, or a gas produced by a chemical reaction. The exhaust material may be a gas, liquid, plasma, or, before the chemical reaction, a solid, liquid, or gel. The propellant may take the form of a fuel combusted with the air. Propellants may fill the interior of a cartridge or a chamber to direct the force of resulting from ignition. Explosives can be placed in a sealed tube and act as a deflagrant low explosive charge to produce a low velocity heave effect (gas pressure blasting). Cold gas propellants (gas generator propellants) including nitrous oxide and the dimethyl ether or low-boiling alkane, may be implemented and stored in a can. In addition to the propellants and example uses listed above, chemical energy can be released and used as propellant by mixing two chemicals or with the addition of water. It should be appreciated that any suitable propellant may be implemented in an actual implementation.

Some possible uses of propellant charges in subsea landing string applications may include, but are not limited to: replace nitrogen in hydraulic accumulators and pressure balanced accumulators PBA; eliminate or minimize the precharge of nitrogen accumulators at surface and reduce the accumulator size; replace downhole pumps that replenish accumulators; provide a backup energy in case of downhole pump failure; provide backup emergency hydraulic power in case of failure of hydraulic accumulators or control system; actuate subsea landing string valves, downhole tools, tubing hanger running tool or other functions; bypass the normal control valves and provide hydraulic/gas power directly to the actuators, thereby actuating the actuators faster and/or with more energy; providing the propellant gas pressure directly to operate devices with no other control fluid or to supplement the control fluid pressure. Additionally, the temperature generated by the propellant may be used as a confirmation the device was actuated. This temperature may be measured by one or more instruments deployed within the installation.

Additionally, there may be many possible uses of propellant charges for other subsea applications including: replace or supplement accumulators used to operate any hydraulically operated device subsea; replace or supplement accumulators used on BOPs (may include land and dry BOPs; replace or supplement accumulators used on subsea wellhead trees and subsea manifolds; replace or supplement accumulators used by ROVs to operate equipment not installed or carried by the ROV; replace or supplement accumulators used by ROVs to operate equipment on or carried by the ROV including buoyancy tanks, including special ROV tool kits which store hydraulic power the ROV connects to a subsea device (e.g., pipeline and flowline connectors); replace or supplement accumulators used for subsea pipeline and flow line connections; and replace or supplement accumulators used on operate open water riser intervention systems during tree installation, completion installation, intervention, flow back operations and/or preparations for well abandonment.

Further, there may be many uses for propellant charges for downhole tool applications, including: opening of downhole valves such as an FIV, opening or closing of DST valves, and closing of a safety valve.

While the present disclosure has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the disclosure.

What is claimed is:

1. A method comprising:

deploying a propellant system and at least one component to a subsea location;

arming the propellant system using a control system; and igniting a propellant in the propellant system in response to losing communication with the control system, while the propellant system is armed, wherein, when communication with the control system is lost, the propellant system is unable to receive a signal from the control system, and wherein ignition of the propellant actuates the at least one component.

2. The method of claim 1, wherein the propellant system is also configured to ignite the propellant in response to receiving the signal from the control system while the propellant system is armed and before losing communication with the control system.

3. The method of claim 1, wherein the signal is a hydraulic signal.

4. The method of claim 1, wherein the signal is an electrical signal.

5. The method of claim 1, wherein the signal comprises a plurality of hydraulic and electrical signals from the control system.

6. The method of claim 1, wherein the at least one component comprises a shut-off valve of a subsea test tree.

7. The method of claim 1, wherein the at least one component comprises a shear ram or a pipe ram.

8. The method of claim 1, further comprising directly actuating the at least one component with the propellant.

9. The method of claim 1, further comprising actuating the at least one component with hydraulic fluid pressurized by a piston in direct communication with the propellant.

10. A subsea system comprising:

a control system;

a propellant system in a subsea location and in communication with the control system, the propellant system ignitable by the control system in response to losing communication with the control system, after being placed in an armed state by the control system, wherein the propellant system is unable to receive a signal from the control system upon losing communication with the control system; and a component in the subsea location and in communication with the propellant system, wherein the component is actuatable by the propellant system after ignition of the propellant system.

11. The system of claim 10, wherein the control system comprises at least one of a hydraulic component, an electrical component, and a chemical component usable for controlling the propellant system.

12. The system of claim 10, wherein the propellant system has two operating states:

the armed state; and a disarmed state, wherein the propellant system is also configured to be actuated by receiving the signal before losing communication with the control system while in the armed state.

13. The system of claim 10, wherein the component comprises at least one of a shut-off valve, a shear ram, and a pipe ram.

14. The system of claim 10, wherein the propellant system comprises:

a firing head;

a prong configured to hold the firing head in place until the firing head is exposed to a predetermined pressure, at which point, the firing head moves with respect to the prong;

an igniter; and a propellant in contact with the igniter, wherein the firing head impacts the igniter to ignite the propellant.

15. The system of claim 14, wherein the propellant system comprises:

a second firing head;

a second igniter; and a second propellant in contact with the second igniter, wherein the firing head and the second firing head are actuated by a common communication from the control system.

16. The system of claim 10, further comprising an umbilical running to surface.

17. The system of claim 10, wherein the propellant system is located about a tubular in which the component is located.

18. The system of claim 10, wherein the propellant system comprises an electrical firing circuit comprising at least one of: a battery, a charged capacitor, and a surface electrical connection.

19. The system of claim 10, wherein the propellant system comprises a piston displaceable upon ignition to pressurize hydraulic lines and actuate the component.

20. The system of claim 14, wherein the prong comprises:

a first protrusion configured to engage a first recess formed in the firing head; and a second protrusion configured to engage a second recess formed in a body of the propellant system, wherein the first and second protrusions are spaced axially-apart from one another.

* * * * *